US005899836A

United States Patent [19]

Chen

[11] Patent Number: 5,899,836

[45] Date of Patent: May 4, 1999

[54] EXERCISER FOR PULLING AND STEPPING EXERCISES

[76] Inventor: Paul Chen, 5F., No. 31, Gan Tzou 2nd St., Shi Tun Chu, Taichung, Taiwan

[21] Appl. No.: 09/004,347

[22] Filed: Jan. 8, 1998

[51] Int. Cl.[6] ..... A63B 21/00

[52] U.S. Cl. ..... 482/92; 482/95; 482/96; 482/130; 482/72

[58] Field of Search ..... 482/92, 95, 96, 482/72, 130

[56] References Cited

U.S. PATENT DOCUMENTS

| | | | |
|---|---|---|---|
| 459,282 | 9/1891 | Gollon | 482/96 |
| 4,272,074 | 6/1981 | Sferle | 482/96 |
| 5,334,120 | 8/1994 | Rasmussen | 482/96 |
| 5,507,709 | 4/1996 | Wu | 482/96 |
| 5,722,917 | 3/1998 | Olschansky | 482/96 |

*Primary Examiner*—Jerome Donnelly

[57] ABSTRACT

An exerciser includes a foot support secured in front of a base. A lever has a lower portion pivotally coupled to the base and has a bracket and a seat cushion pivotally secured on tops for allowing the seat cushion to be moved upward and downward. A tube is secured to the bracket for supporting one or more pulleys. The base has one or more pulleys secured to the front and the rear portions. One or more resilient members are engaged with the pulleys. A handle may be secured to the resilient member for conducting pulling exercises. The tube and the may be moved upward and downward in concert with the seat cushion.

7 Claims, 2 Drawing Sheets

EXERCISER FOR PULLING AND STEPPING EXERCISES

BACKGROUND OF THE INVENTION

1. Field of the Invention

The present invention relates to an exerciser, and more particularly to an exerciser for conducting both pulling and stepping exercises.

2. Description of the Prior Art

Typical stepping exercisers may be used for conducting stepping exercises only and may not be provided for conducting pulling exercises. Typical pulling type exercisers may not be provided for conducting stepping exercises.

The present invention has arisen to mitigate and/or obviate the afore-described disadvantages of the conventional pulling exercisers and stepping exercisers.

SUMMARY OF THE INVENTION

The primary objective of the present invention is to provide an exerciser which can be used for conducting both stepping and pulling exercises.

In accordance with one aspect of the inventions there is provided an exerciser comprising a base including a front portion and a rear portion, a foot support secured to the front portion of the base, at least one lever including a lower portion pivotally coupled to the rear portion of the base and including an upper portion, a bracket pivotally secured on the upper portion of the lever for allowing the bracket to be moved up and downs the bracket including a rear portions a seat cushion disposed on the bracket and adapted to be moved upward and downward in concert with the bracket, means for applying a resistance force against an upward and downward movement of the bracket and the seat cushion, a tube secured to the rear portion of the bracket and including an upper portion, at least one first pulley secured on the upper portion of the tube, at least one second pulley secured to the front portion of the bases at least one third pulley secured to the rear portion of the base, at least one resilient member engaged through the third pulley and engaged with the first pulley and the second pulleys the resilient member including two ends, and at least one handle adapted to be secured to either of the ends of the resilient members for allowing the handle to be pulled. The tube and the first pulley are moved upward and downward in concert with the seat cushion.

The base includes an extension slidably engaged in the front portion of the bases the foot support is secured on the extension for allowing the foot support to be adjusted relative to the base and the seat cushion.

The tube includes a middle portion pivotally coupled to the bracket at a pivot pin for allowing the tube to be folded to engage with the seat cushions and the tube includes a lower portion, and means for securing the lower portion of the tube to the bracket.

An extension is slidably secured in the upper portion of the tubes a bar is secured on top of the extension, the first pulley is secured to the bar for allowing the first pulley to be adjusted up and down relative to the seat cushion.

A limiting means is further provided for limiting a downward movement of the seat cushion. The limiting means includes a stay having a lower portion secured to the base and having an upper portion for engaging with the bracket and for limiting the upward and downward movement of the seat cushion. The lower portion of the stay is pivotally coupled to the base at a pivot shaft for allowing the stay to be folded about the pivot shaft to engage with the base.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
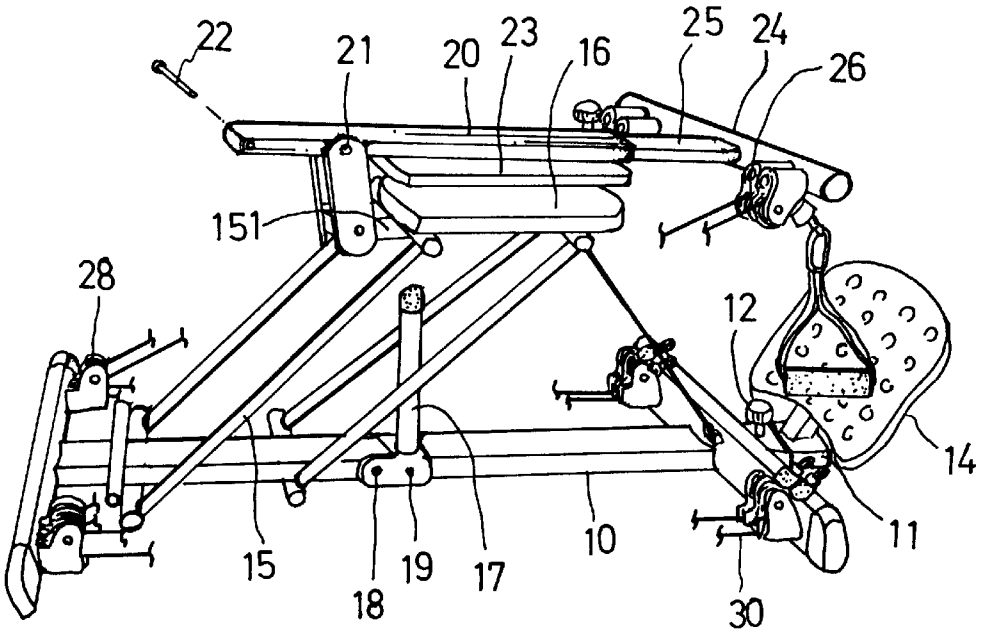
FIG. 2 is a partial perspective view of the exerciser.
Figure 1:
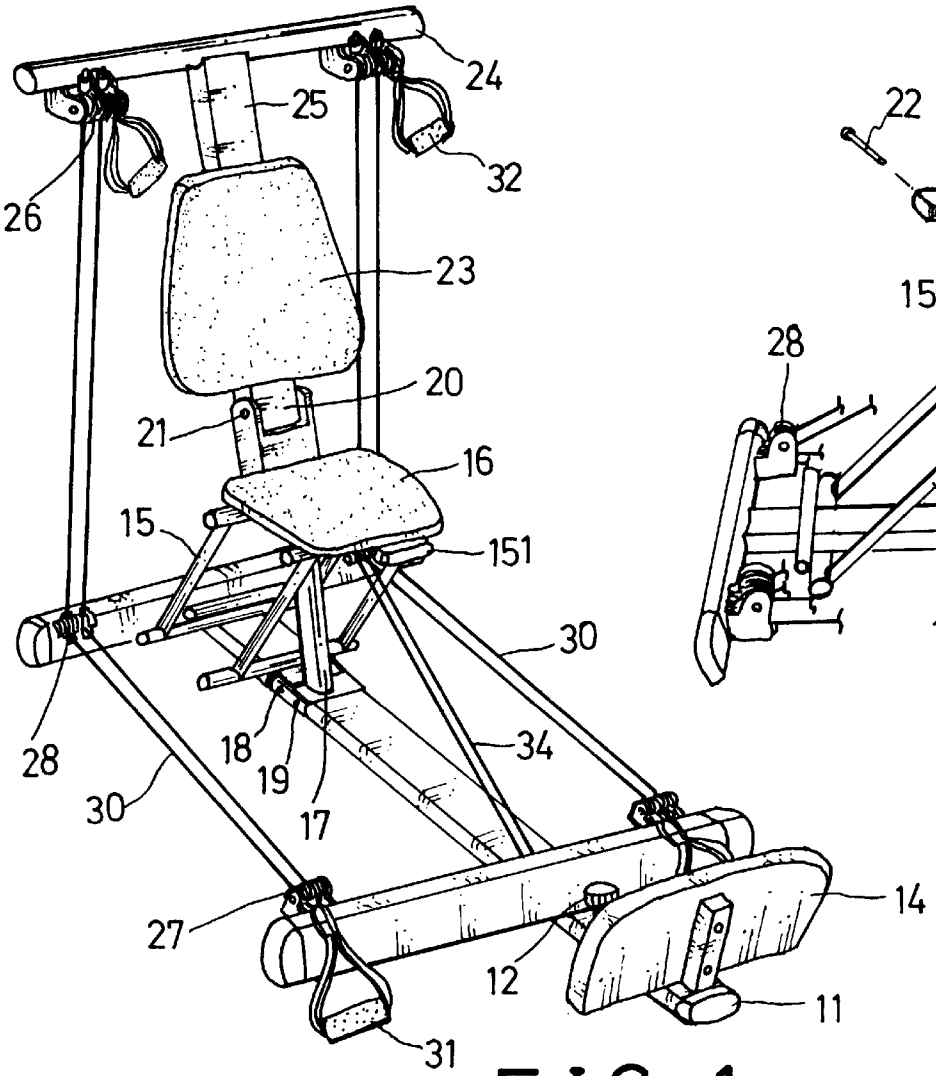
FIG. 1 is a perspective view of an exerciser in accordance with the present invention.
Figure 3:
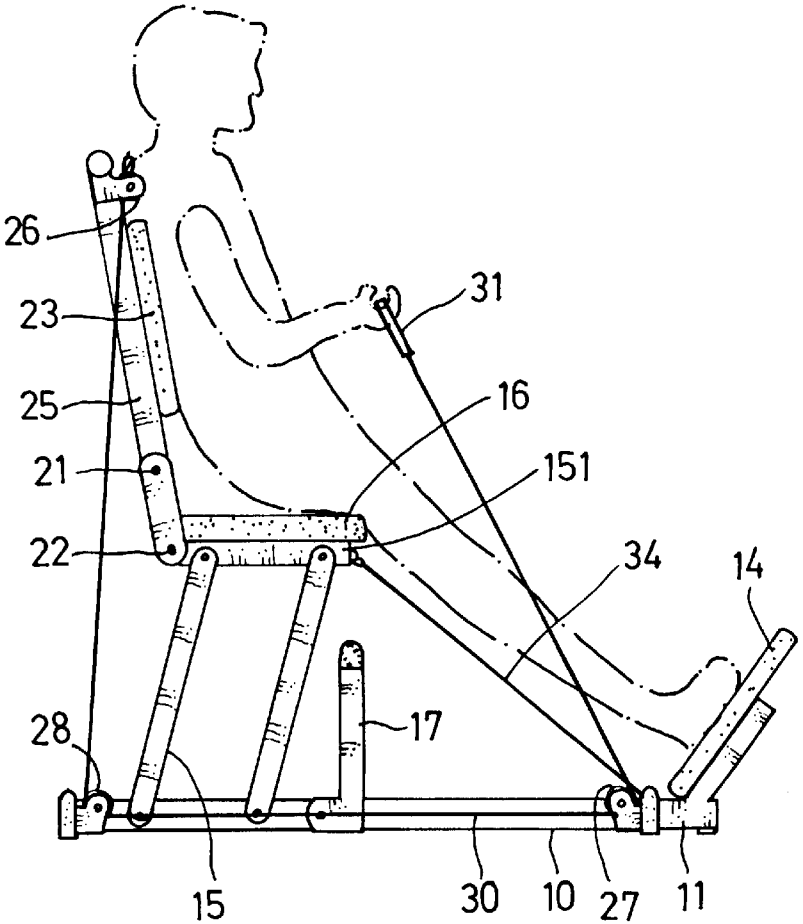
FIGS. 3 and 4 are side views illustrating the operation of the exerciser.

Referring to the drawings, and initially to FIGS. 1–3, an exerciser in accordance with the present invention comprises a base 10 having an extension 11 slidably engaged in the front portion and secured to the base 10 by a fastener 12. A foot support 14 is secured to the extension 11 for allowing the foot support 14 to be adjusted forward and rearward relative to the base 10. One or more levers 15 have a lower portion pivotally secured to the base 10. A bracket 151 is pivotally secured to the upper portion of the levers 15 for supporting a seat cushion 16 and for allowing the seat cushion 16 to be moved upward and downward. A stay 17 has a lower portion pivotally coupled to the base 10 at a pivot shaft 18 and may be secured to a position perpendicular to the base 10 by a fastener 19, for engaging with the bracket 151 and for limiting the downward movement of the seat cushion 16. The stay 17 may be folded to engage with the base 10 for allowing the levers 15 and the bracket 151 to be folded to engage with the base 10. A resistive member 34, such as a resilient belt, may be coupled between the base 10 and the bracket 151 for applying a resistive force against the upward movement of the seat cushion 16.

A tube 20 includes a middle portion pivotally coupled to the bracket 151 at a pivot pin 21 and includes a bottom end secured to the bracket 151 by a fastener 22 for allowing the tube 20 to be secured to a position perpendicular to the bracket 151 and the base 10. A cushion 23 may be secured to the tube 20 for engaging with the back of the user. An extension 25 is slidably engaged in the tube 20 and is adjustable up and down relative to the tube 20. A bar 24 is secured on top of the extension 25 for supporting one or more pulleys 26. The front portion and the rear portion of the base 10 each may include one or more pulleys 27, 28, for engaging with a resilient member 30, such as a resilient belt or strip, which is also engaged with the pulley 26. A handle 31, 32 may be secured to either of the ends of the resilient member 30 for allowing the user to conduct pulling exercises (FIGS. 3 and 4.

Figure 4:
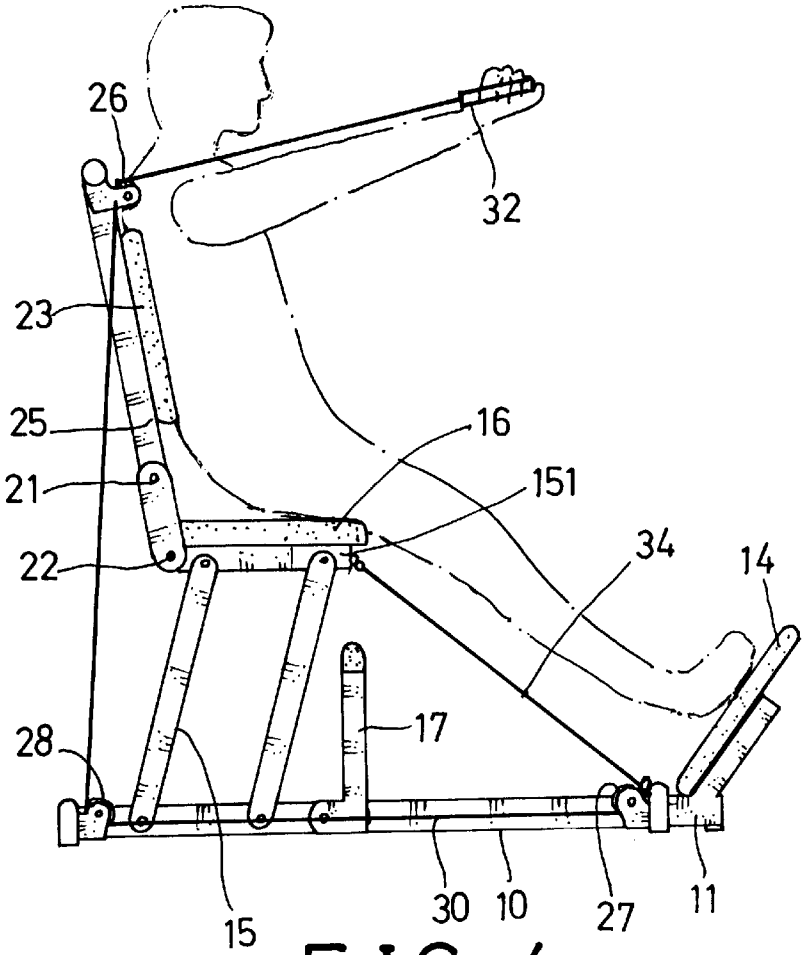

In operation, as shown in FIGS. 3 and 4, the user may elevate the seat cushion 16 against the resistive member 34 for conducting stepping exercises. The handle 31, 32 may also be used for allowing the user to conduct pulling exercises.

It is to be noted that the tube 20 and the pulleys 26 may also be moved upward in concert with the seat cushion 16, such that the handles 32 may be smoothly pulled and will not be interfered by the upward movement of the tube 20 or the cushion 23 or the user. Without the stay 17, the base 10 may itself include an upward extending portion for engaging with the bracket 151 and for limiting the downward movement of the seat cushion 16.

Accordingly, the exerciser in accordance with the present invention may be used for conducting both stepping and pulling exercises. In addition, the bar 24 and the tube 20 and the pulleys 26 may all be moved upward in concert with the seat cushion 16 when the seat cushion 16 is moved upward by the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a front portion and a rear portion, a foot support secured to said front portion of said base, at least one lever including a lower portion pivotally coupled to said rear portion of said base and including an upper portion, a bracket pivotally secured on said upper portion of said at least one lever for allowing said bracket to pivotally move up and down, said bracket including a rear portion, a seat cushion disposed on said bracket and adapted to pivotally move upward and downward in concert with said brackets means for applying a resistance force against an upward and downward movement of said bracket and said seat cushion, a tube secured to said rear portion of said bracket and including an upper portions at least one first pulley secured on said upper portion of said tubes at least one second pulley secured to said front portion of said bases at least one third pulley secured to said rear portion of said base, at least one resilient member engaged through said at least one third pulley and engaged with said at least one first pulley and said at least one second pulleys said at least one resilient member including two ends, and at least one handle adapted to be secured to either of said ends of said resilient members for allowing said at least one handle to be pulled, said tube and said at least one first pulley being moved upward and downward in concert with said seat cushion.

2. The exerciser according to claim 1, wherein said base includes an extension slidably engaged in said front portion of said base, said foot support is secured on said extension for allowing said foot support to be adjusted relative to said base and said seat cushion.

3. The exerciser according to claim 1, wherein said tube includes a middle portion pivotally coupled to said bracket at a pivot pin for allowing said tube to be folded to engage with said seat cushions and said tube includes a lower portions and means for securing said lower portion of said tube to said bracket.

4. The exerciser according to claim 1 further comprising an extension slidably secured in said upper portion of said tube, a bar secured on top of said extension, said at least one first pulley being secured to said bar for allowing said at least one first pulley to be adjusted up and down relative to said seat cushion.

5. The exerciser according to claim 1 further comprising means for limiting a downward movement of said seat cushion.

6. The exerciser according to claim 5, wherein said limiting means includes a stay having a lower portion secured to said base and having an upper portion for engaging with said bracket and for limiting the upward and downward movement of said seat cushion.

7. The exerciser according to claim 6, wherein said lower portion of said stay is pivotally coupled to said base at a pivot shaft for allowing said stay to be folded about said pivot shaft to engage with said base.

* * * * *